US006540570B1

(12) United States Patent
Eakin

(10) Patent No.: US 6,540,570 B1
(45) Date of Patent: Apr. 1, 2003

(54) COUNTER-ROTATING TRANSMISSION

(76) Inventor: Robert C. Eakin, 585 Bucktail Rd., Franklin, PA (US) 16323

( * ) Notice: Subject to any disclaimer, the term of this patent is extended or adjusted under 35 U.S.C. 154(b) by 0 days.

(21) Appl. No.: 10/047,864

(22) Filed: Jan. 16, 2002

(51) Int. Cl.[7] ..... B63H 7/00
(52) U.S. Cl. ..... 440/37; 440/75
(58) Field of Search ..... 440/37, 75

(56) References Cited

U.S. PATENT DOCUMENTS

| | | | |
|---|---|---|---|
| 1,329,387 | A | 2/1920 | Fay |
| 1,434,620 | A | 11/1922 | McCain |
| 1,881,080 | A | 10/1932 | Hubert |
| 4,540,369 | A | 9/1985 | Caires |
| 4,642,059 | A | 2/1987 | Nohara |
| 4,884,949 | A | 12/1989 | Eakin |
| 5,247,856 | A | 9/1993 | Cuypers |
| D350,838 | S | 9/1994 | Kaye |
| 5,601,464 | A | 2/1997 | Ogino et al. |
| 5,724,867 | A | 3/1998 | Jordan |
| 5,759,073 | A | 6/1998 | Sumino et al. |
| 5,788,546 | A | 8/1998 | Ogino |
| 5,791,592 | A | 8/1998 | Nolan et al. |
| 5,807,149 | A | 9/1998 | Kaye |
| 5,890,938 | A | 4/1999 | Eick et al. |
| 5,911,793 | A | 6/1999 | Kaye |
| 5,921,826 | A | 7/1999 | Asberg et al. |
| 6,053,782 | A | 4/2000 | Jordan |
| 6,186,922 | B1 | 2/2001 | Bursal et al. |

FOREIGN PATENT DOCUMENTS

| | | |
|---|---|---|
| DE | 3939187 A1 | 5/1990 |
| JP | 404059495 A | 2/1992 |

*Primary Examiner*—Jesus D. Sotelo
(74) *Attorney, Agent, or Firm*—Thorp Reed & Armstrong, LLP

(57) ABSTRACT

A transmission, for use with a drive shaft carrying a driving pulley, comprises a frame having a front and a back. The back of the frame has an opening for receiving the drive shaft and the driving pulley while the front of the frame has an opening for receiving a transmission assembly. The transmission assembly comprises a primary driven shaft carrying a pulley and a hollow, secondary, driven shaft coaxial with the primary driven shaft. A drive gear is carried by the primary driven shaft. An idler gear is driven by the drive gear and a driven gear, carried by the secondary driven shaft, is driven by the idler gear to effect rotation of the secondary driven shaft in a direction opposite to the direction of rotation of the primary driven shaft.

10 Claims, 14 Drawing Sheets

COUNTER-ROTATING TRANSMISSION

BACKGROUND OF THE INVENTION

1. Field of the Invention

The present invention is directed to transmissions and, more particularly, to transmissions of the counter-rotating type used on airboats.

2. Description of the Background

Speed conversion is an important capability in the efficient utilization of rotary motive force. The need often arises for increasing or decreasing the speed of a driven member to a higher or lower speed, respectively, than that of a driving member. That is accomplished through the use of a transmission. Transmissions are found in various machines in which speed conversion is required. For example, in automobiles, a hydraulic transmission, with various combinations of gears, accomplishes the task of converting the high rotary speed of the gasoline engine to the lower rotational requirements of the driven axle. Typically, such transmissions are quite complex, requiring many parts to operate in synchronization, and are quite labor intensive for both assembly and service. Other machines in which speed conversion is necessary include water vessels and airboats. In water vessels and airboats, the ultimate driven member is a propeller. However, airboats may be provided with two propellers rotating in opposite directions, referred to as counter-rotating propellers. The transmission system for such a counter-rotating propeller system is typically more complex than a transmission system for a single propeller.

U.S. Pat. No. 5,807,149 entitled Airboat Systems and Methods for Increasing Engine Efficiency While Reducing Torque and Noise is one example of an airboat propulsion system in which a propeller is rotated by a hollow driven shaft. A further embodiment is provided wherein two propellers are rotated in opposite directions by counter-rotating coaxial hollow driven shafts. Other examples include U.S. Pat. No. 6,053,782 entitled Airboat Transmission, Lubrication System, and Associated Method and U.S. Pat. No. 5,724,867 entitled Airboat Transmission. In all three of those patents, the engine's drive shaft is connected to the driven shafts through a series of gears.

Airboats are often powered by aircraft engines operating at approximately 2,500–3,000 revolutions per minute (rpm), but most use automobile engines that operate at 4,800 to 5,200 rpm. At those high speeds, using gears to couple the drive shaft of the engine to the driven shafts which carry the counter-rotating propellers places a high degree of stress on the gears and shafts. As a result, the gears can become locked up and shafts snap off, conditions that are difficult and expensive to repair. Thus, the need exists for a transmission system capable of reducing the rpm's while efficiently coupling the torque of an automotive engine to the counter-rotating propellers of an airboat.

SUMMARY OF THE PRESENT INVENTION

The present invention is directed to a counter-rotating, belt-driven transmission for use in connection with an airboat. The transmission comprises a frame having a front and a back. The front of the frame has an opening for receiving a drive shaft carrying a pulley while the back the frame has an opening for receiving a transmission assembly. The transmission assembly comprises a primary driven shaft carrying a pulley and a hollow, secondary, driven shaft coaxial with the primary driven shaft. A floating drive gear is carried by the primary driven shaft. Four idler gears are driven by the drive gear. A driven gear, carried by the secondary driven shaft, is driven by the idler gears to effect rotation of the secondary driven shaft in a direction opposite to the direction of rotation of the primary driven shaft. The belt drive of the present invention provides for an efficient coupling of the engine's torque to the driven shafts while eliminating the possibility of lock-up of the transmission. The belt drive also eliminates the transmission of shock loads to the gears. The transmission assembly is sized to be a direct replacement for existing transmissions which have a single driven shaft and propeller. Those, and other advantages and benefits, will be apparent from the Description of the Preferred Embodiments herein below.

BRIEF DESCRIPTION OF THE DRAWINGS

For the present invention to be easily understood and readily practiced, the present invention will now be described, for purposes of illustration and not limitation, in conjunction with the following figures, wherein.

DESCRIPTION OF THE PREFERRED EMBODIMENTS

Figure 1:
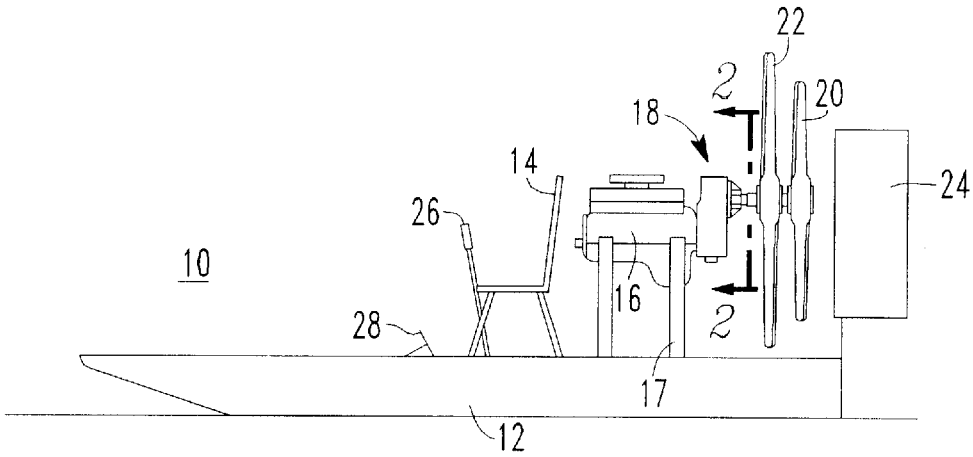
FIG. 1 is a side view of an airboat utilizing the transmission of the present invention.

An airboat 10 is illustrated in FIG. 1. The airboat 10 is comprised of a hull 12 carrying a seat 14 and an engine 16. The engine 16 may be an aircraft engine or, more typically, an automobile engine. The engine 16 is carried by the hull 12 by any suitable engine mount 17 as is known in the art. The hull 12 also carries a transmission 18 which is used to couple the torque developed by the engine 16 to a first propeller 20 and a second propeller 22 which rotates in a direction opposite to the direction of rotation of the first propeller 20. Hence, the transmission 18 is referred to as a counter-rotating type of transmission. Typically, the propellers 20, 22 are surrounded by a cage (not shown) for safety reasons. The hull 12 also carries a rudder 24 used for steering as is known. A control 26 is used to control the position of the rudder while a control 28 is used to control the speed of the engine 16.

Figure 2:
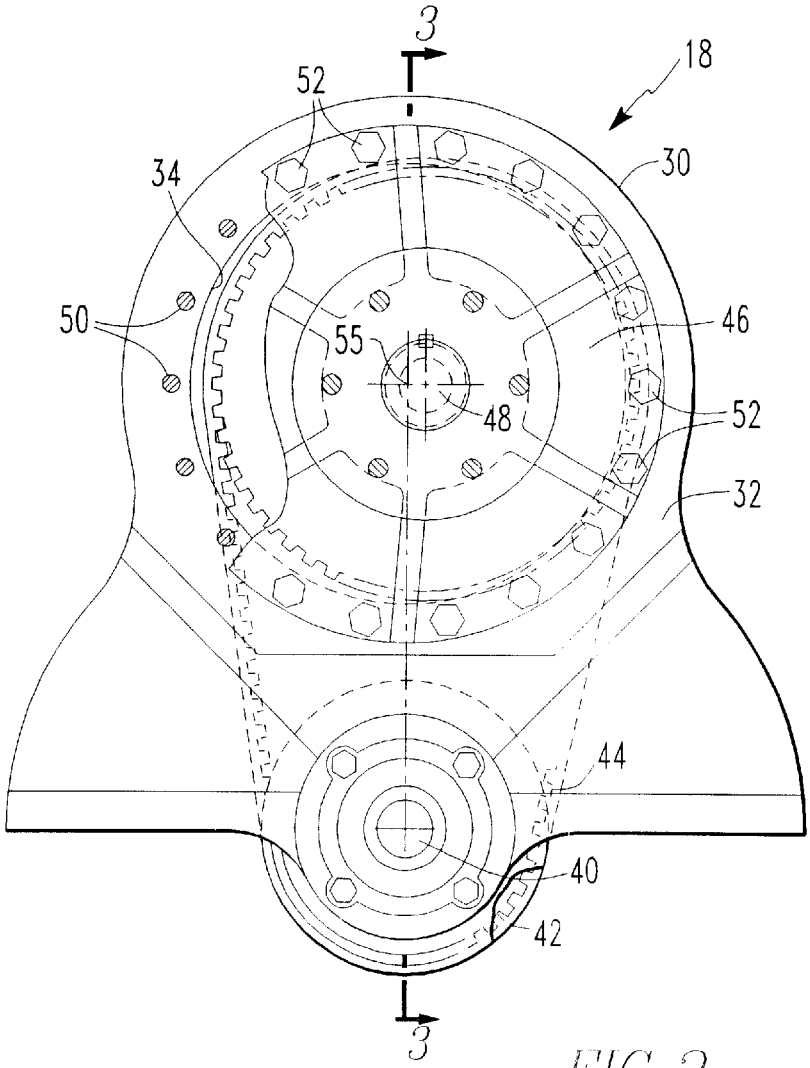
FIG. 2 is a view taken along the line II—II in FIG. 1.

FIG. 2 illustrates a view of the transmission 18 taken along the lines II—II in FIG. 1 with parts broken away. The transmission 18 is comprised of a transmission frame 30 having a back 32 having an opening 34 for receiving a transmission assembly 33 (best seen in FIG. 3). The transmission frame 30 also has a front 36 (best seen in FIG. 3) having an opening 38 for receiving a drive shaft 40 (best seen in FIG. 2) of the engine 16. The front 36 of the transmission frame 30 is adapted to be bolted or otherwise attached to the rear of the engine 16 in any known manner.

A drive pulley 42 is carried on the drive shaft 40. The drive pulley is designed to mesh with the teeth of a belt 44. The belt 44 is connected to a driven pulley 46 carried on a first (proximal) end of a primary driven shaft 48. In that manner, rotary motion of the drive shaft 40 is imparted to the primary driven shaft 48. By appropriate sizing of the drive pulley 42 and the driven pulley 46, speed reduction may be effected. Additionally, by lengthening the longitudinal axis of the transmission frame 30, and using a longer belt 44, the engine may be mounted closer to the bottom of the hull 12, thereby lowering the center of gravity making the airboat 10 safer.

The opening 34 in the in the back of the transmission frame 30 is surrounded by a ring of threaded bolt holes 50 for receiving bolts 52. As will be described in greater detail below, the bolts 52 are used to connect the transmission assembly 33 to the transmission frame 30. A center line 54 of the primary driven shaft 48 is offset from a center 55 of the ring of bolt holes 50. In that manner, when the bolts 52 are removed, the transmission assembly 33 may be rotated to bring a different set of holes in the transmission assembly 33 into alignment with the bolt holes 50 to thereby adjust the tension on the belt.

Figure 3:
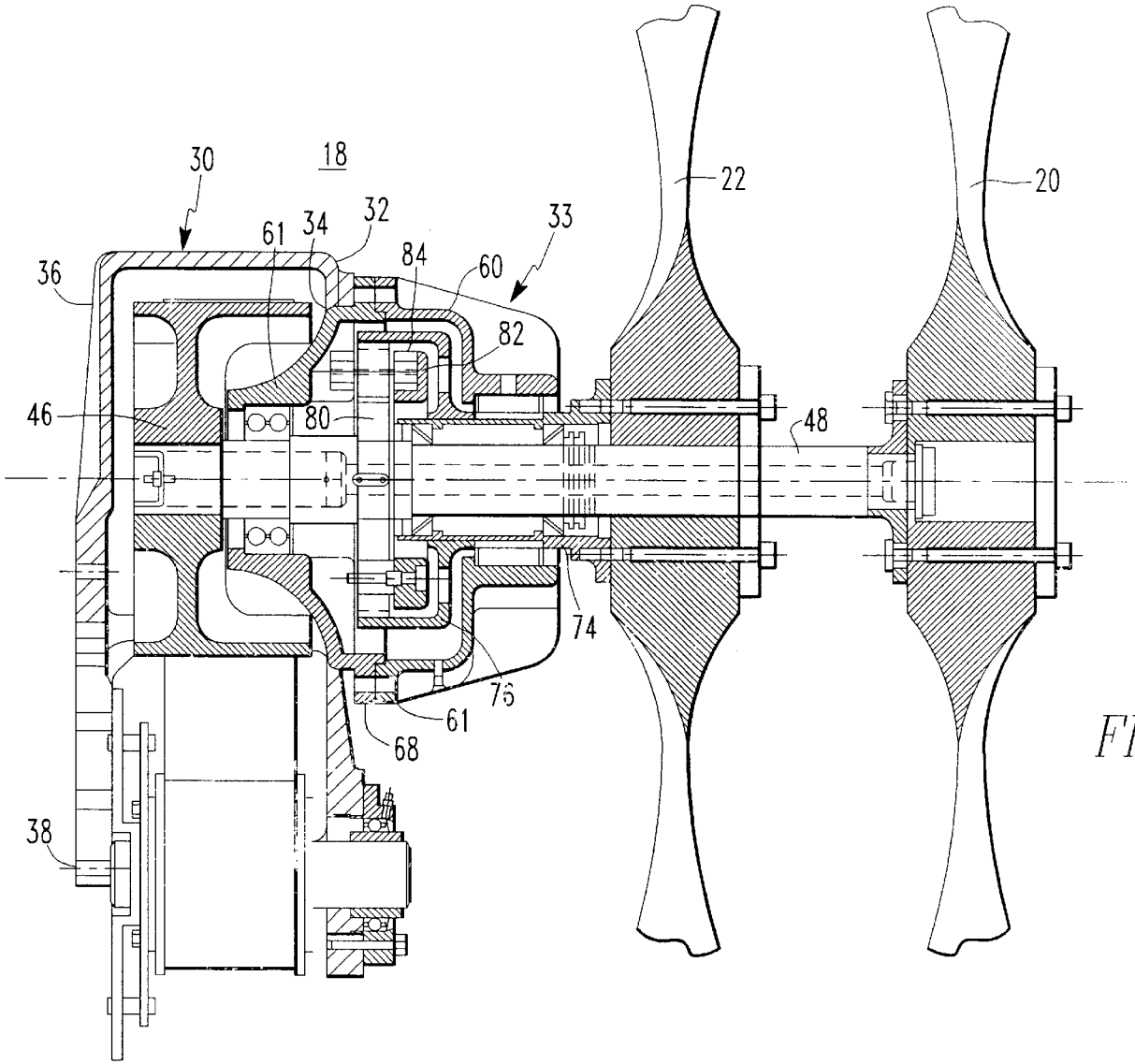
FIG. 3 is a partial sectional view of the drive system.
Figure 4:
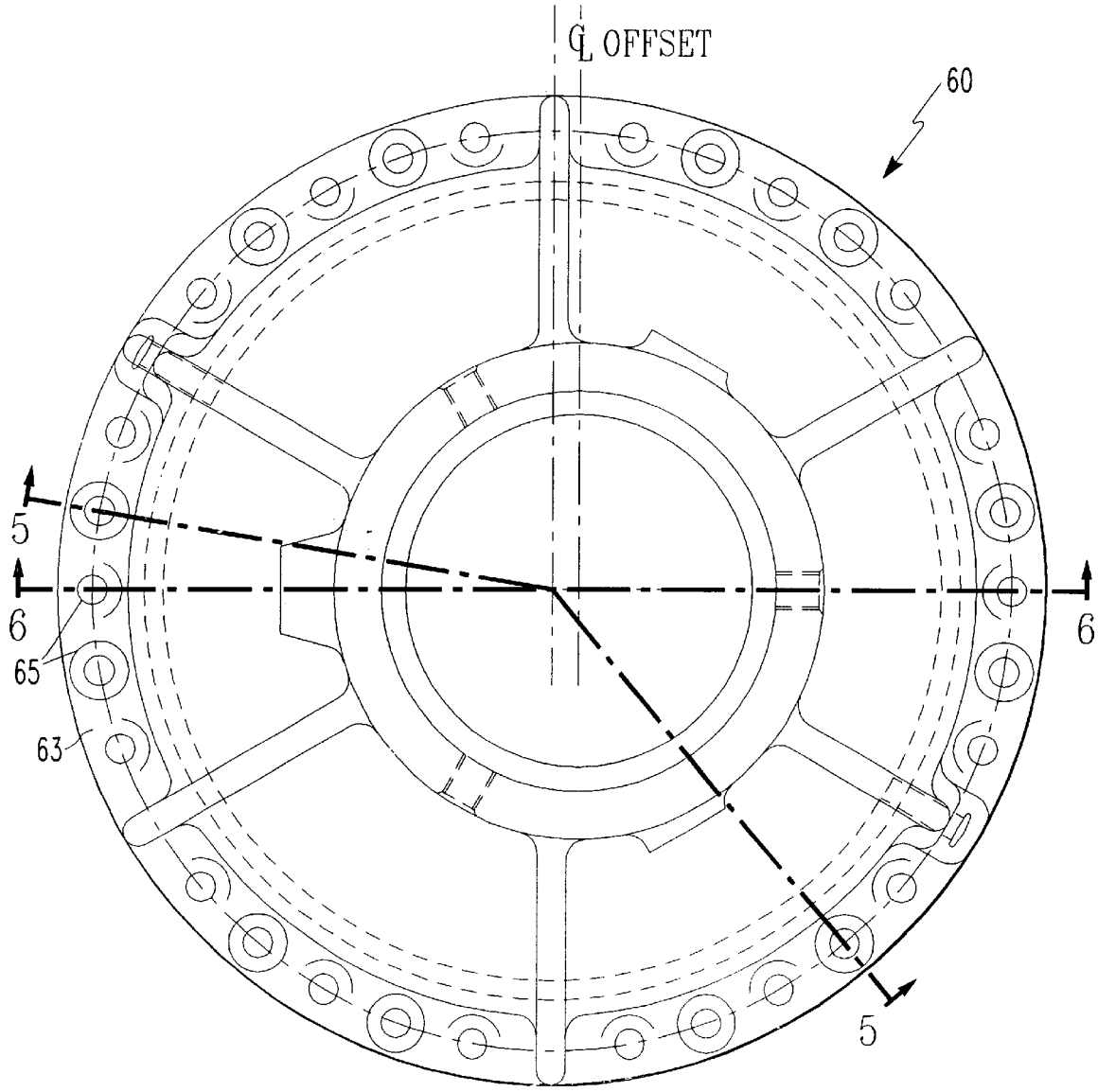
FIGS. 4, 5 and 6 illustrate a front housing of a transmission assembly.
Figure 5:
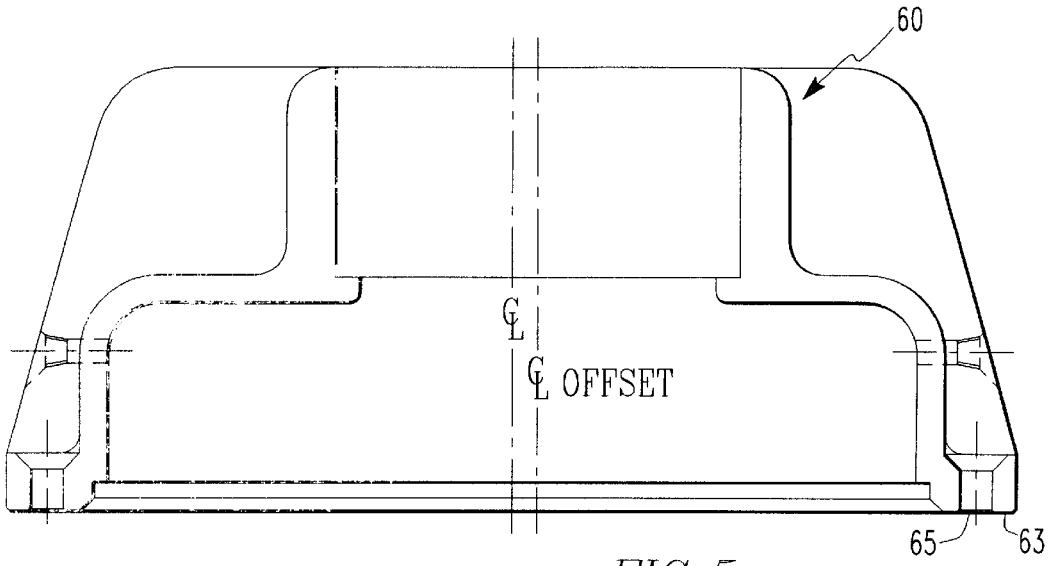
Figure 6:
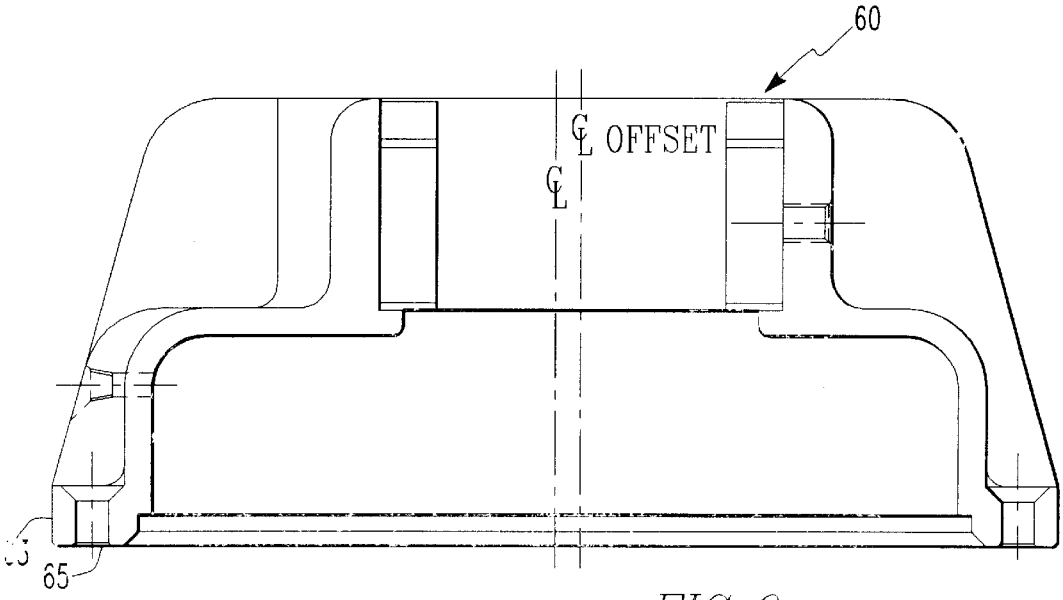
Figure 7:
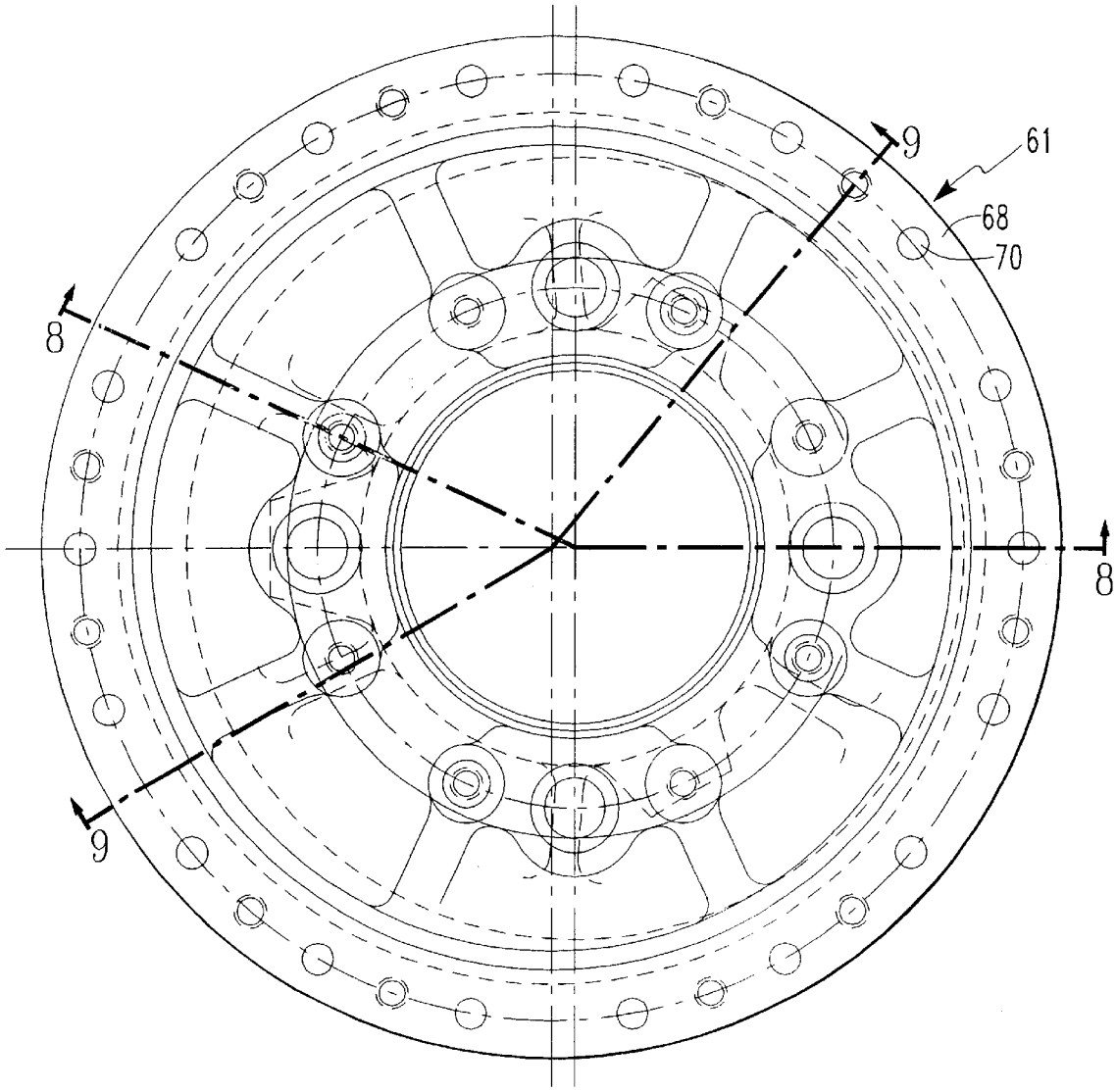
FIGS. 7, 8 and 9 illustrate a rear housing of the transmission assembly.
Figure 8:
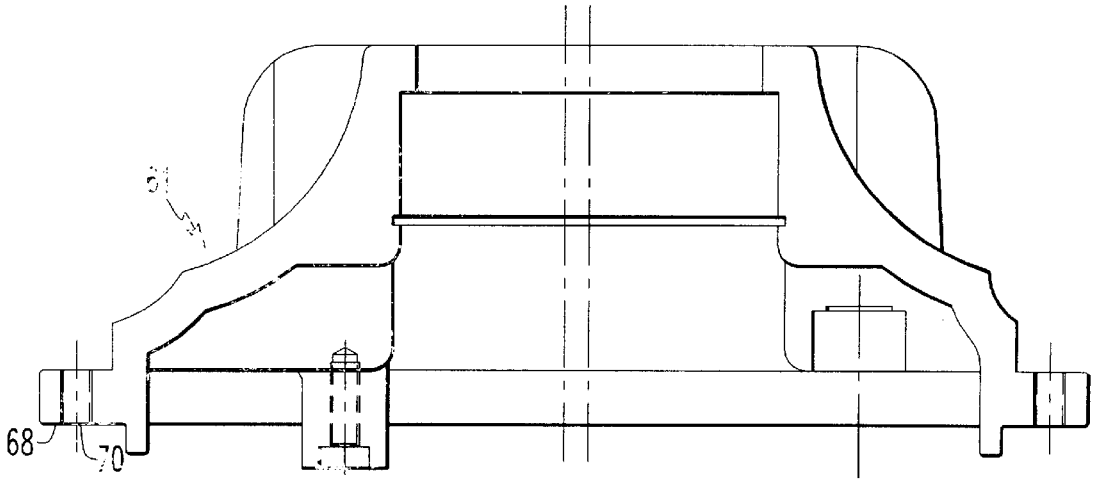
Figure 9:
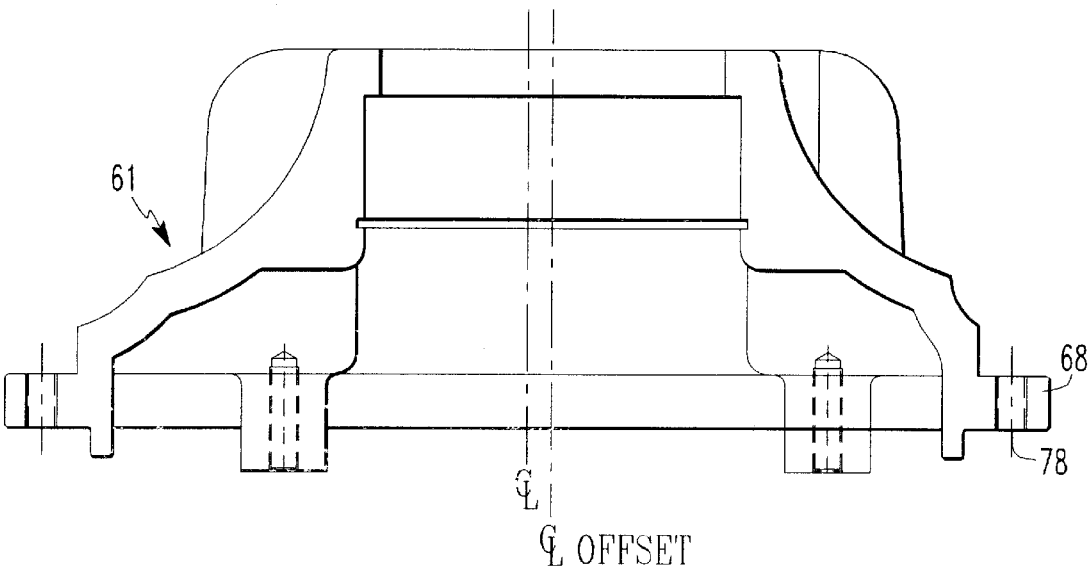

Turning now to FIG. 3, the transmission assembly 33 is comprised of a front housing 60, illustrated in detail in FIGS. 4, 5, and 6, and a rear housing 61, illustrated in detail in FIGS. 7, 8, and 9. As seen best in FIG. 4, the front housing 60 has a flange 63 having a plurality of through holes 65. Similarly, the rear housing 61 has a flange 68 (seen best in FIG. 7) having through holes 70. The holes 70 in flange 68 of rear housing 61 match up with the holes 65 in the flange 63 of the front housing 60. The holes 70 and 65 receive the bolts 52 which threadably engage bolt holes 50 on the back 32 of the transmission frame 30 as shown in FIG. 2. In that manner, not only are the front housing 60 and rear housing 61 held together, but the transmission assembly 33 is connected to the transmission frame 30.

Figure 10A:
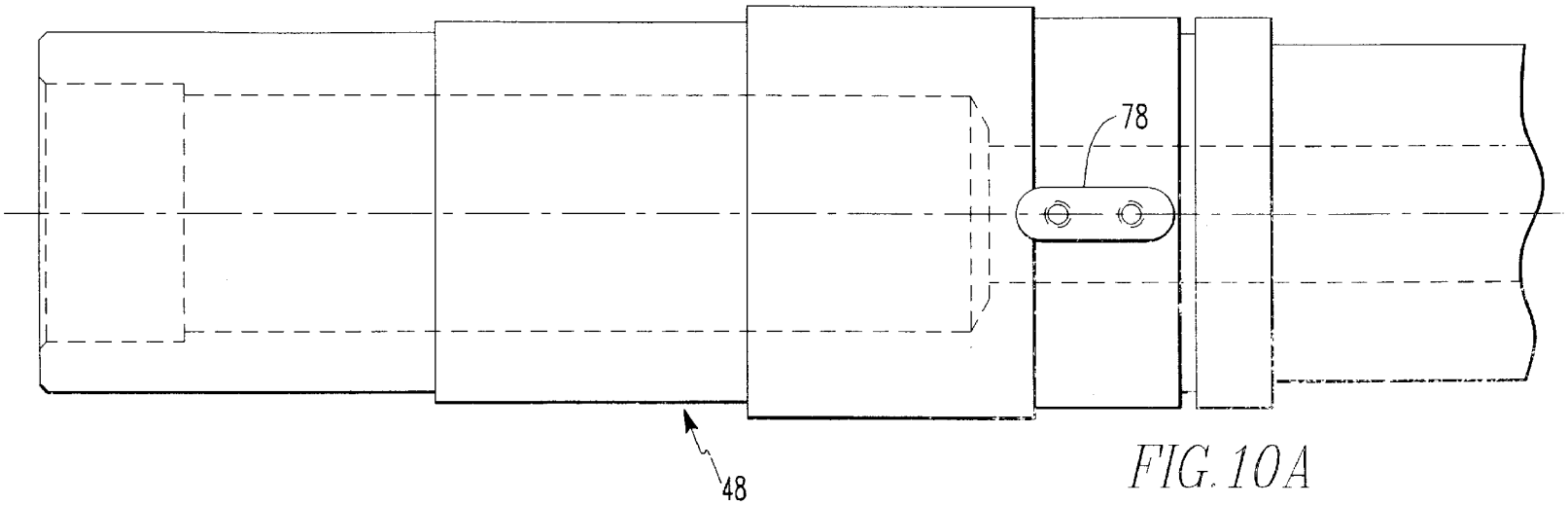
FIGS. 10A and 10B illustrate a primary driven shaft.
Figure 10B:
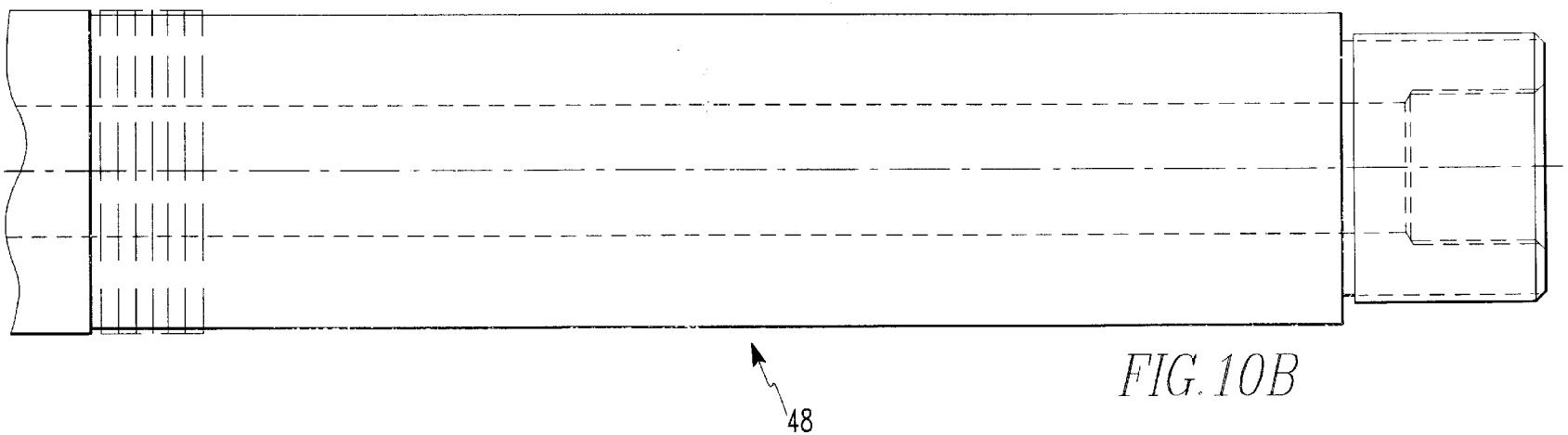
Figure 12:
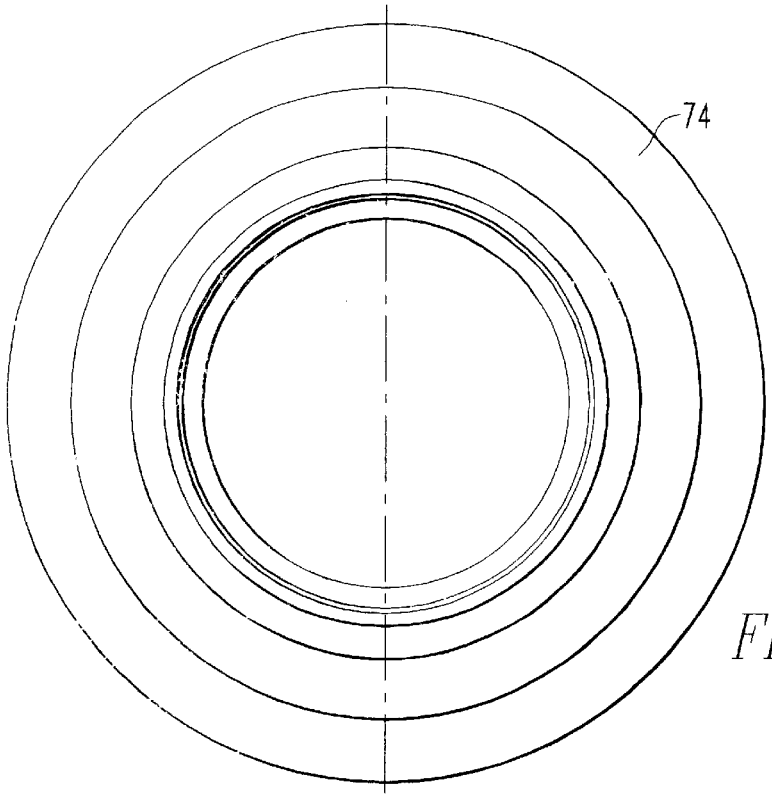
FIGS. 11, 12 and 13 illustrate a secondary driven shaft.
Figure 11:
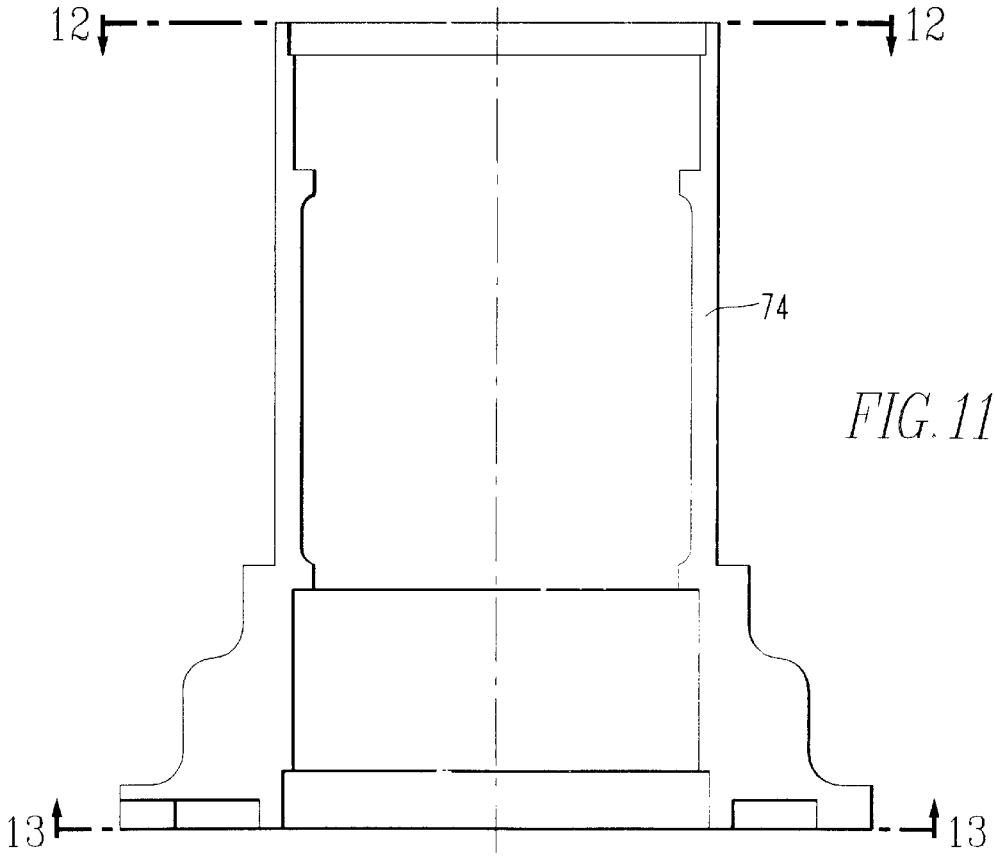
Figure 13:
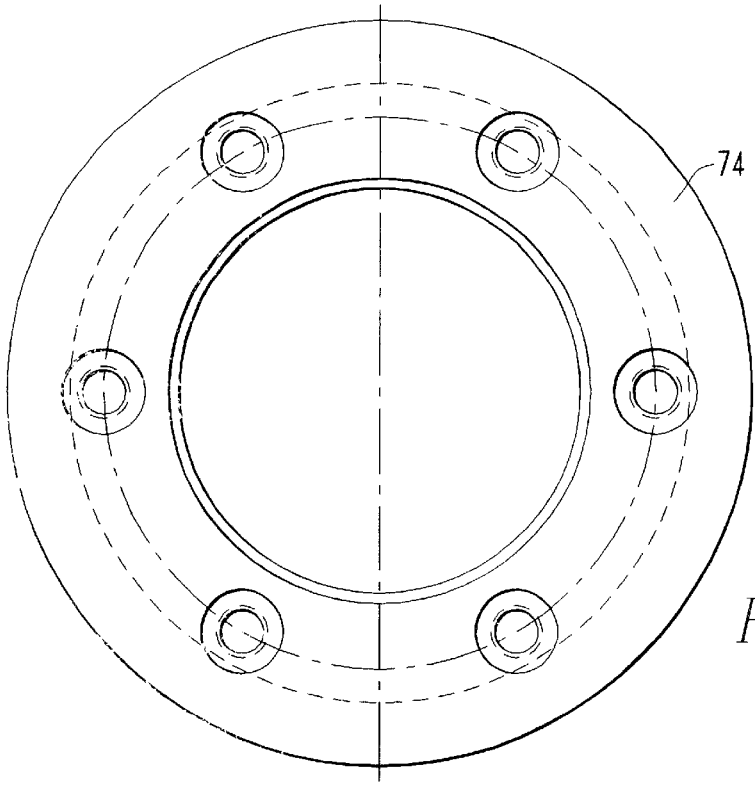
Figure 14:
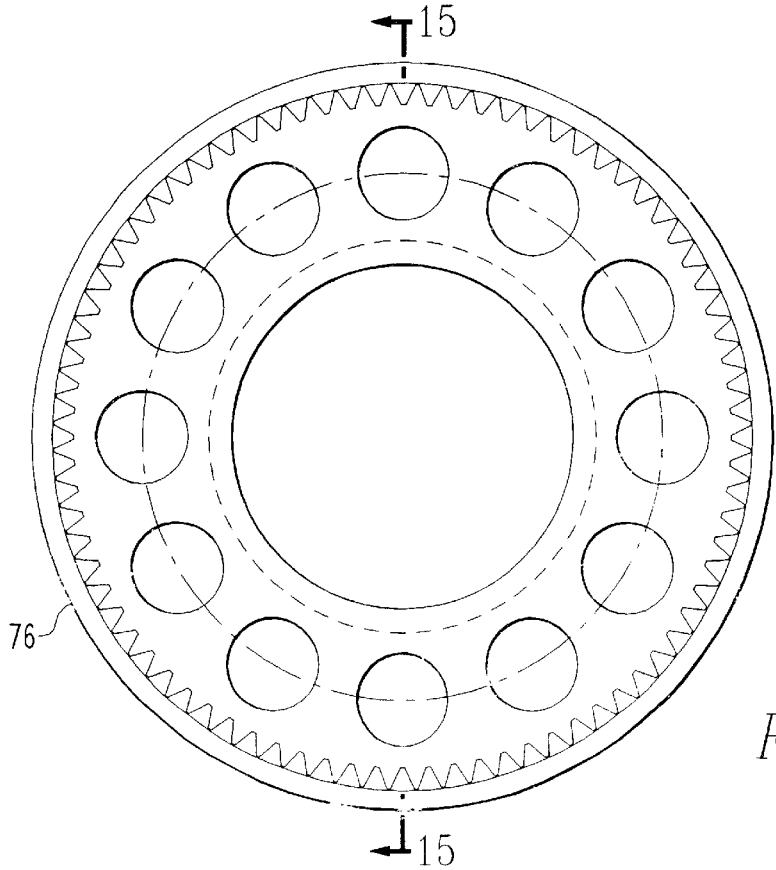
FIGS. 14 and 15 illustrate a cup-shaped, containment, ring gear.
Figure 15:
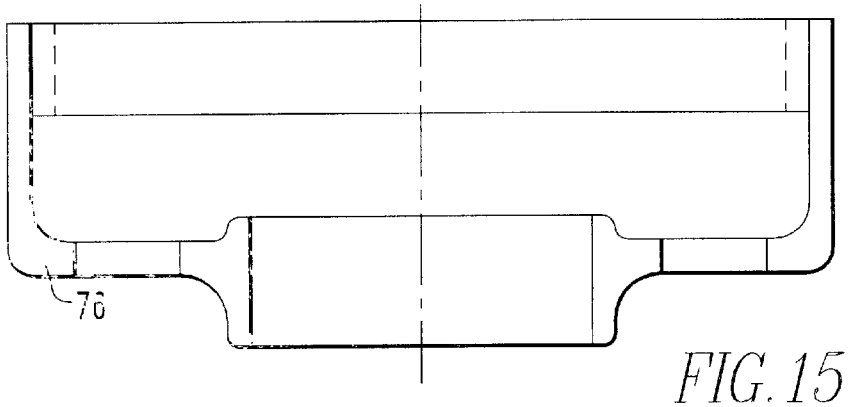

Returning to FIG. 3, the primary driven shaft 48 is illustrated. As previously described, the primary driven shaft 48 has at its proximal end a driven pulley 46 and, at its distal end, the propeller 20. The propeller 20 is rigidly attached to the primary drive shaft 48 and rotates therewith. Details of the primary drive shaft 48 are illustrated in FIGS. 10A and 10B. The transmission assembly 33 is also comprised of a secondary driven shaft 74. The secondary driven shaft 74 is hollow as seen in FIGS. 11, 12, and 13 and is concentric with the primary driven shaft 48. The secondary driven shaft 74 carries at its proximal end a cup-shaped, containment, ring gear 76, seen best in FIGS. 14 and 15. The secondary driven shaft 74 carries at its proximal end the propeller 22. As will be described below, the propeller 22 rotates in a direction opposite to the direction of rotation of the primary driven shaft 48, propeller 20, and engine 16.

Figure 16:
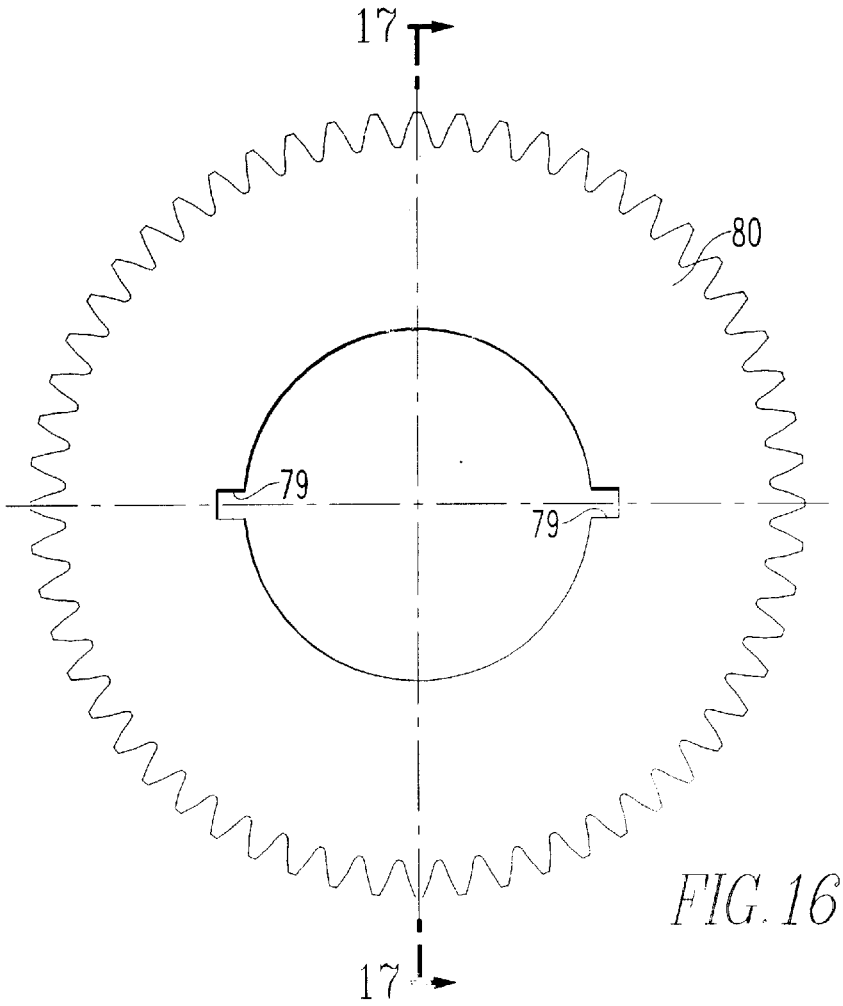
FIGS. 16 and 17 illustrate a sun gear.
Figure 17:
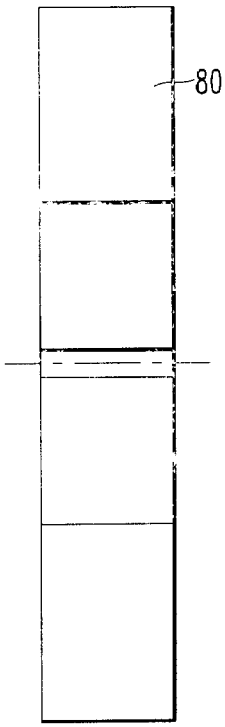
Figure 18:
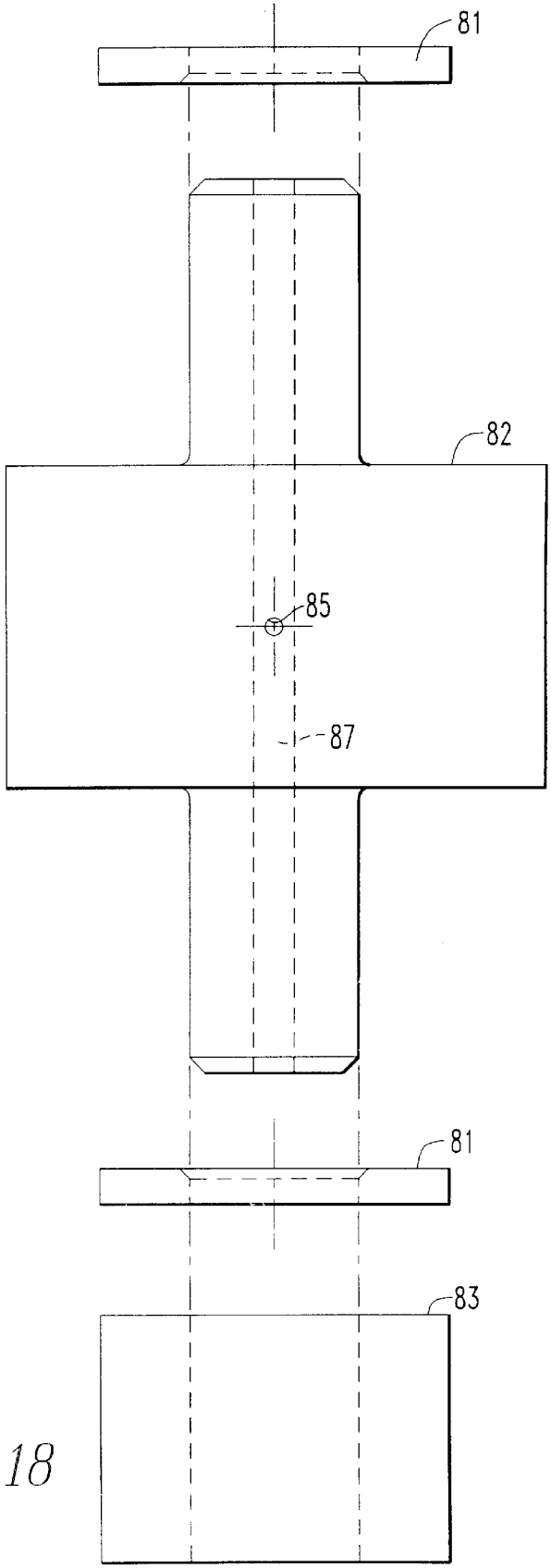
FIGS. 18 and 19 illustrate one of a plurality of planet gears.
Figure 19:
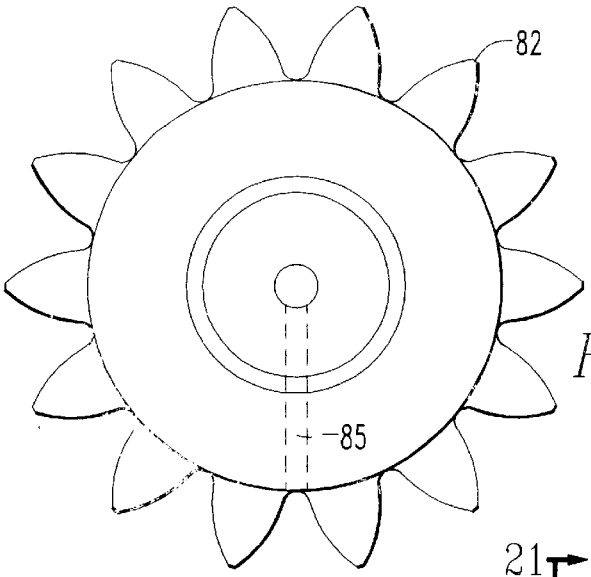

Returning to FIG. 3, the primary driven shaft 48 carries a sun gear 80, seen best in FIG. 16. The sun gear 80 has notches 79 such that when the sun gear 80 is carried by the primary driven shaft 48, the notches 79 engage keys 78, seen in FIG. 10A, causing sun gear 80 to rotate with primary driven shaft 48. The sun gear 80, rather than being rigidly attached to the primary driven shaft 48, is allowed to float thereon while being driven by keys 78. That allows the load to be distributed in a manner that enables the sun gear 80 to find its own equilibrium point. Interposed at the periphery of the sun gear 80 is a plurality of planetary gears 82. One of the planetary gears is shown in detail in FIGS. 18 and 19. In FIG. 18, each of the planetary gears 82 is used in conjunction with a pair of thrust bearings 81 and a needle bearing 83.

Figure 20:
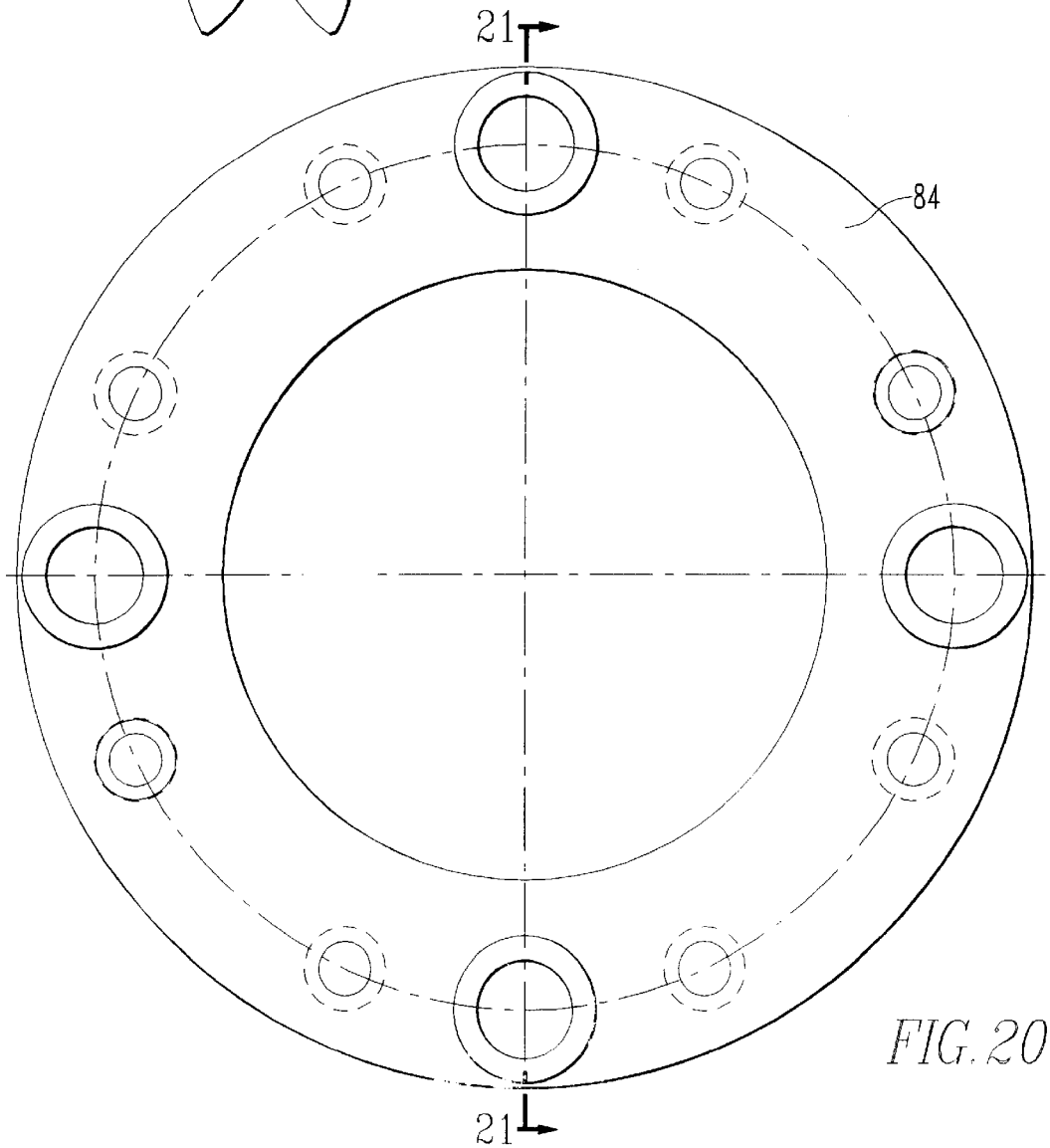
FIGS. 20 and 21 illustrate a support ring.
Figure 21:
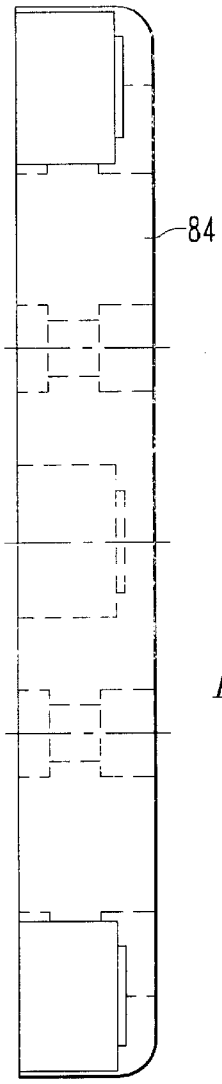

In the presently preferred embodiment, four planetary gears are provided. The planetary gears are spaced 90° from one another and held in their relative locations by a support ring 84 shown in detail in FIGS. 20 and 21. The support ring 84 maintains the relative position of the planetary gears 82 such that the planetary gears 82 act as an idler gear, driven by the sun gear 80 carried by the primary driven shaft 48. The planetary gears 82, in turn, drive the containment ring gear 76. In that manner, containment ring gear 76, and hence secondary driven shaft 74, rotate in a direction which is opposite to the direction of rotation of primary driven shaft 48. Through that mechanism, the transmission assembly 33 provides counter-rotating shafts such that the drive system of FIG. 3 provides counter-rotating propellers 20, 22.

Oil is pumped into the planet needle bearings 83 by a hole 85 through one of the teeth of each of the planetary gears 82, and a lateral hole 87, allowing oil to be pushed as the ported tooth in the planetary gears 82 meshes with sun gear 80 and cup-shaped containment gear 76.

One aspect of the present invention is the sizing of the transmission assembly 33. Airboat Drive Units, Inc. of Franklin, Pa., has in the past provided transmissions having a single propeller. The transmission assembly 33 of the present invention is sized to fit within the transmission frame of previously provided transmissions, such that a transmission assembly 33 of the type disclosed in the present invention may be substituted for transmission assemblies of the prior art type for driving a single propeller. In that manner, users wishing to convert from a single propeller to two counter-rotating propellers need purchase only a transmission assembly 33 rather than an entire new transmission.

Another aspect of the present invention is the sizing of propellers 20, 22. In the presently preferred embodiment, I prefer a slower turning, steeper pitch propeller for propeller 22. That is believed to create an air feeding system with slower propeller 22 pulling in more air from a larger diameter to feed the faster moving propeller 20, thereby increasing the thrust produced per foot pound of torque applied. The propellers 20, 22, because they turn in opposite directions, eliminate the resulting gyroscopic forces on the airboat 10. Also, the slower turning, higher torque propeller 22 should help to neutralize the effects of the engine torque on airboat 10. While I prefer to use the different sized propellers with a transmission of the type described, the benefits of using different sized propellers could be obtained when used in conjunction with other types of transmissions, including transmissions that are connected to the engine's drive shaft through a gear rather than a belt, such as those disclosed in U.S. Pat. No. 5,724,867 entitled Airboat Transmission, U.S. Pat. No. 5,807,149 entitled Airboat Systems and Methods for Increasing Engine Efficiency While Reducing Torque and Noise and U.S. Pat. No. 6,053,782, and U.S. Pat. No. 6,186,922 entitled In-Line Transmission With Counter-Rotating Outputs, which are hereby incorporated by reference.

Figure 24:
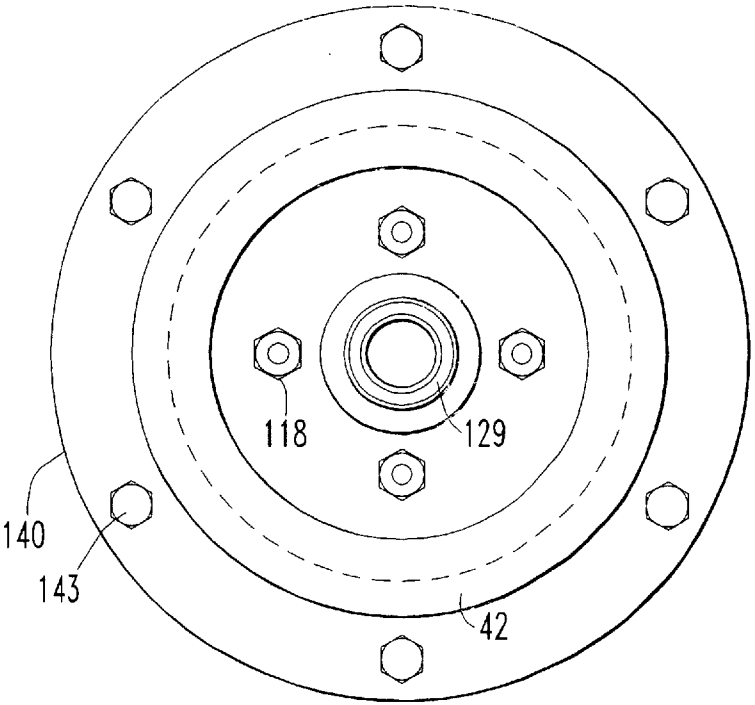
FIGS. 23 and 24 illustrate a mechanism for connecting a drive shaft to a drive pulley.
Figure 23:
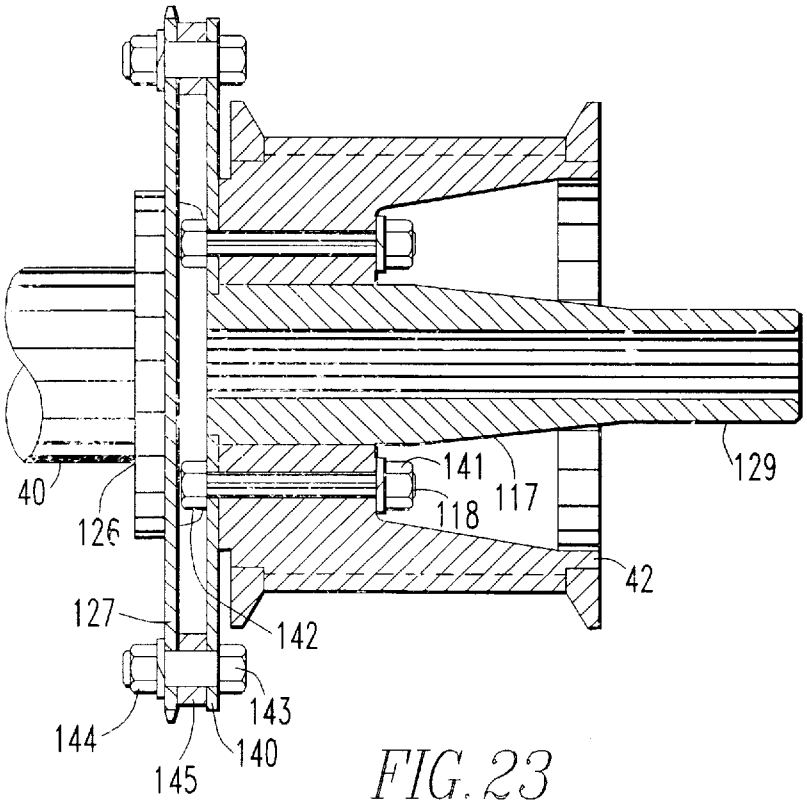

One method of connecting the engine's drive shaft 40 to the drive pulley 42 is shown in FIGS. 23 and 24. The drive pulley 42 is connected to a flexible plate 140 by bolts 118 which have nuts 141 and heads 142 that rigidly fasten plate 140 to pulley 42. Plate 140 is attached to a flywheel 127 by means of bolts 143, nuts 144 and spacers 145; flywheel 127 is connected to a flange 126 which extends from drive shaft 40. Plate 140 provides flexibility in misalignment between drive shaft 40 and shaft 117 to which is fixed pulley 42 and absorbs vibration. The outboard end 129 of shaft 117 is intended to be received in a bearing. The reader desiring more details about FIGS. 23 and 24 is directed to U.S. Pat. No. 4,884,949 entitled Drive Units For Air Driven Vehicles which is hereby incorporated by reference.

Figure 22:
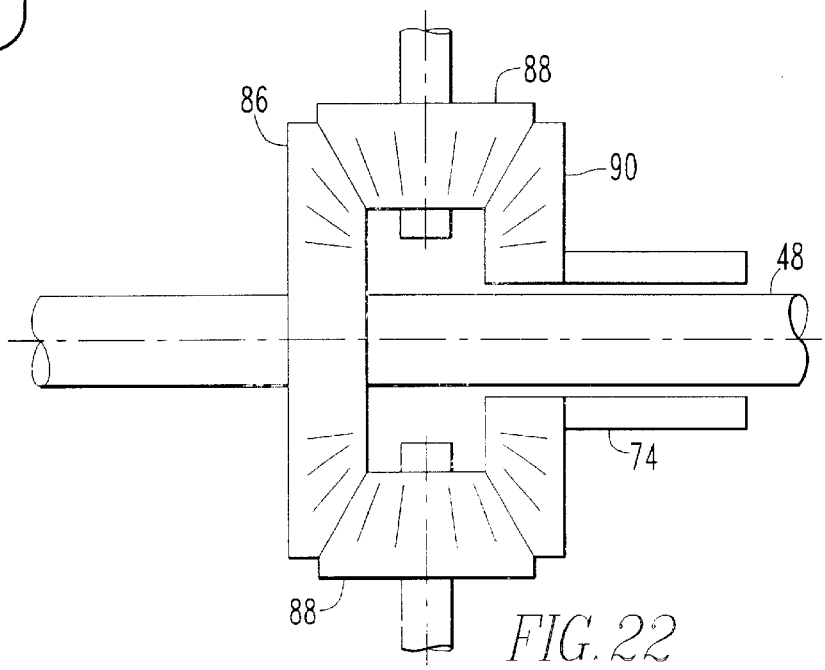
FIG. 22 illustrates a second embodiment for providing counter-rotating shafts.

Finally, the sun and planetary gear arrangement disclosed herein, while it is believed to be the most compact and efficient way to achieve counter-rotation, is not the only mechanism for providing counter-rotating shafts where one of the shafts is a hollow shaft concentric with the other shaft. For example, in FIG. 22, a first bevel gear 86 is carried by the primary driven shaft 48. The first bevel gear 86 drives pinions 88. The pinions 88 in turn drive a second bevel gear 90 which is carried by the secondary driven shaft 74. Those of ordinary skill in the art will recognize that many schemes are available for providing for counter-rotation. The present invention is intended to cover such modifications and variations and is not intended to be limited by the specific disclosure of a sun and planetary gears, bevel gears and pinions, or any of the other specifics of the presently preferred embodiment. The present invention is intended to be limited only by the following claims and to any equivalents to which they may be entitled.

What is claimed is:

1. An airboat, comprising:

a hull;

an engine carried by said hull, said engine having a drive shaft;

a primary driven shaft carrying a first propeller;

a belt connecting said drive shaft to said primary driven shaft;

a hollow, secondary, driven shaft coaxial with said primary driven shaft and carrying a second propeller;

a drive gear carried by said primary driven shaft;

an idler gear driven by said drive gear;

a driven gear, carried by said secondary driven shaft, and driven by said idler gear to effect rotation in a direction opposite to the direction of rotation of said primary driven shaft; and a rudder carried by said hull.

2. The airboat of claim 1 wherein said drive gear includes a floating sun gear, said idler gear includes a plurality of planetary gears, and said driven gear includes a ring gear.

3. The airboat of claim 1 wherein said drive gear includes a first beveled gear, said idler gear includes a plurality of pinions in contact with said first beveled gear, and said driven gear includes a second beveled gear in contact with said plurality of pinions.

4. The airboat of claim 1 wherein said first propeller is smaller than said second propeller.

5. The airboat of claim 4 wherein said second propeller has a steeper pitch than the pitch of said first propeller.

6. A drive system for driving a pair of counter-rotating shafts, comprising:

a drive shaft carrying a drive pulley;

a primary driven shaft carrying a first propeller on one end and a driven pulley on another end, said drive pulley and said driven pulley sized to effect speed reduction;

a belt connecting said drive pulley to said driven pulley;

a hollow, secondary, driven shaft coaxial with said primary driven shaft and carrying a second propeller;

a drive gear carried by said primary driven shaft;

an idler gear driven by said drive gear; and a driven gear, carried by said secondary driven shaft, and driven by said idler gear to effect rotation in a direction opposite to the direction of rotation of said primary driven shaft.

7. The drive system of claim 6 wherein said drive gear includes a floating sun gear, said idler gear includes a plurality of planetary gears, and said driven gear includes a ring gear.

8. The drive system of claim 6 wherein said drive gear includes a first beveled gear, said idler gear includes a plurality of pinions in contact with said first beveled gear, and said driven gear includes a second beveled gear in contact with said plurality of pinions.

9. The drive system of claim 6 wherein said first propeller is smaller than said second propeller.

10. The drive system of claim 9 wherein said second propeller has a steeper pitch than the pitch of said first propeller.

* * * * *

UNITED STATES PATENT AND TRADEMARK OFFICE

CERTIFICATE OF CORRECTION

PATENT NO. : 6,540,570 B1
DATED : April 1, 2003
INVENTOR(S) : Eakin

It is certified that error appears in the above-identified patent and that said Letters Patent is hereby corrected as shown below:

Column 1,
Line 63, after “back” insert -- of --.

Column 3,
Line 18, after “34” delete “in the” (first occurrence).

Signed and Sealed this

Eighteenth Day of November, 2003

JAMES E. ROGAN
*Director of the United States Patent and Trademark Office*